US008069570B2

(12) United States Patent
Taylor et al.

(10) Patent No.: US 8,069,570 B2
(45) Date of Patent: Dec. 6, 2011

(54) KNIFE SHEATH

(75) Inventors: Morgan Taylor, Kingsport, TN (US); Jiun-Yu Chu, Taipei Hsien (TW)

(73) Assignee: Taylor Brands, LLC, Kingsport, TN (US)

( * ) Notice: Subject to any disclaimer, the term of this patent is extended or adjusted under 35 U.S.C. 154(b) by 233 days.

(21) Appl. No.: 12/357,121

(22) Filed: Jan. 21, 2009

(65) Prior Publication Data

US 2010/0181358 A1 Jul. 22, 2010

(51) Int. Cl.

| | |
|---|---|
| ***B26B 29/04*** | (2006.01) |
| ***B26B 3/06*** | (2006.01) |
| ***F41B 13/04*** | (2006.01) |
| ***B25F 3/00*** | (2006.01) |

(52) U.S. Cl. ..... 30/143; 30/151; 30/295; 224/232; 224/576

(58) Field of Classification Search ..... 30/2, 123, 30/143, 144, 145, 146, 147, 151, 162, 164, 30/165, 167, 295; D22/12, 112, 118, 124, D22/134; D26/38, 46, 34; D8/8, 26, 28, D8/40, 41, 55, 63, 68, 69, 81, 93, 99, 104, D8/105, 303, 311, 313; 224/576, 232, 666
See application file for complete search history.

(56) References Cited

U.S. PATENT DOCUMENTS

| | | | | | |
|---|---|---|---|---|---|
| D137,916 | S | * | 5/1944 | Mrazek | D22/118 |
| 2,359,098 | A | * | 9/1944 | Engle | 30/144 |
| 2,366,202 | A | * | 1/1945 | Lippincott | 362/190 |
| 3,370,163 | A | * | 2/1968 | Brill | 362/119 |
| 3,839,788 | A | * | 10/1974 | Addis | 30/287 |
| 3,865,370 | A | * | 2/1975 | Rogers | 30/165 |
| 4,283,854 | A | * | 8/1981 | Austin | 30/314 |
| 5,467,256 | A | * | 11/1995 | Chen | 362/119 |
| 5,515,249 | A | * | 5/1996 | Shiao | 362/119 |
| 5,629,679 | A | * | 5/1997 | Cranford et al. | 340/574 |
| 5,642,932 | A | * | 7/1997 | Matthews | 362/206 |
| 5,727,319 | A | * | 3/1998 | Myerchin et al. | 30/123 |
| 5,870,826 | A | * | 2/1999 | Lewan | 30/28 |
| 5,893,631 | A | * | 4/1999 | Padden | 362/201 |
| D412,355 | S | * | 7/1999 | Sætherbo | D22/118 |
| 6,145,994 | A | * | 11/2000 | Ng | 362/119 |
| 6,419,371 | B1 | * | 7/2002 | McCalla et al. | 362/119 |
| 6,663,257 | B2 | * | 12/2003 | Galli | 362/119 |
| D490,551 | S | * | 5/2004 | Kim | D26/38 |
| D508,390 | S | * | 8/2005 | Trbovich, Jr. | D8/98 |
| 7,000,323 | B1 | * | 2/2006 | Hatcher et al. | 30/155 |
| 7,163,314 | B2 | * | 1/2007 | Sharrah | 362/206 |
| D545,163 | S | * | 6/2007 | Russell | D8/98 |
| 7,434,316 | B2 | * | 10/2008 | Nenadic | 30/143 |
| D603,239 | S | * | 11/2009 | Kunzendorf | D8/105 |
| 2001/0030864 | A1 | * | 10/2001 | Winkler et al. | 362/208 |
| 2009/0071980 | A1 | * | 3/2009 | Wagner et al. | 222/113 |

FOREIGN PATENT DOCUMENTS

GB 2437798 A * 11/2007

* cited by examiner

*Primary Examiner* — Boyer D Ashley
*Assistant Examiner* — Samuel A Davies
(74) *Attorney, Agent, or Firm* — Luedeka, Neely & Graham, PC

(57) ABSTRACT

A knife and sheath for housing the knife, the sheath including a light, an actuator for activating the light, and finger openings, with the knife being withdrawn from the sheath to permit the fingers of the user to be inserted through the finger receiving openings and enable a thumb of the user to be positioned on the actuator for selective activation and deactivation of the light emitting device.

2 Claims, 4 Drawing Sheets

KNIFE SHEATH

This invention relates to a sheath for an implement such as a knife, and more particularly to such a sheath provided with conveniently manipulatable illuminating means.

BACKGROUND OF THE INVENTION

In the course of outdoor activities such as camping, hiking, hunting and the like, it often is required or desirable to use an implement such as a knife in darkness. Typically, in seeking to use such an implement in the dark, it requires a search for both such an implement and an illuminating device. It also is desirable in engaging in such activities to carry as few articles as possible to facilitate the handling and transportation of such items. Accordingly, it is the principal object of the present invention to provide a compact article which functions not only as a sheath for an implement such as a knife but also as an illuminating device.

SUMMARY OF THE INVENTION

The principal object of the invention is achieved by providing a sheath for an implement, generally consisting of a housing provided with a recess in a surface thereof for removably receiving a portion of the implement, a light emitting device having an actuating button and a set of finger receiving openings wherein the housing is configured and the actuating button for the light emitting device is positioned relative to the set of finger receiving openings so that the housing may be manually grasped by a user with the fingers of the user extending through the set of openings in the housing and the thumb of the user disposed in a position to facilitate the operation of the actuating button of the light emitting device. Preferably, the light emitting device consists of a light emitting diode energized by a replaceable battery, and the housing is formed of a non-electrically conducting plastic material.

DETAILED DESCRIPTION OF THE PREFERRED EMBODIMENTS OF THE INVENTION

Figure 1:
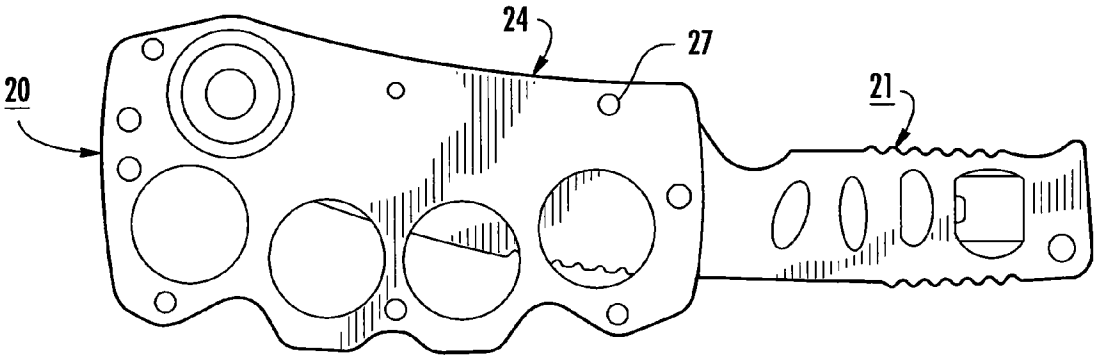
FIG. 1 is a side elevational view of a sheath embodying the invention, having a knife inserted therein.
Figure 2:
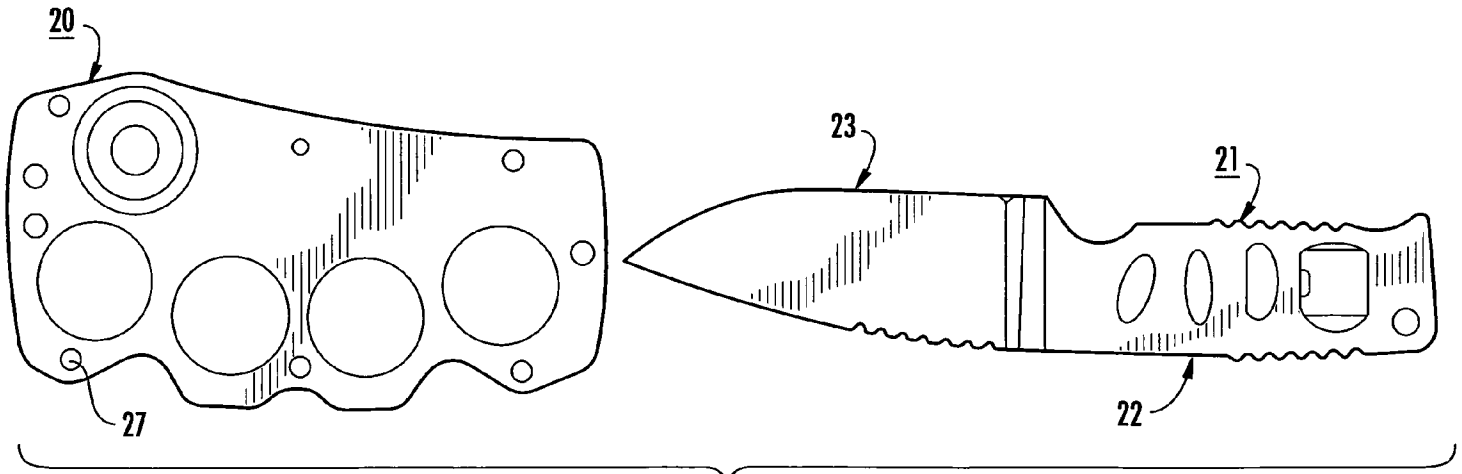
FIG. 2 is a view similar to the view shown FIG. 1, illustrating the knife having been removed from the sheath.
Figure 3:
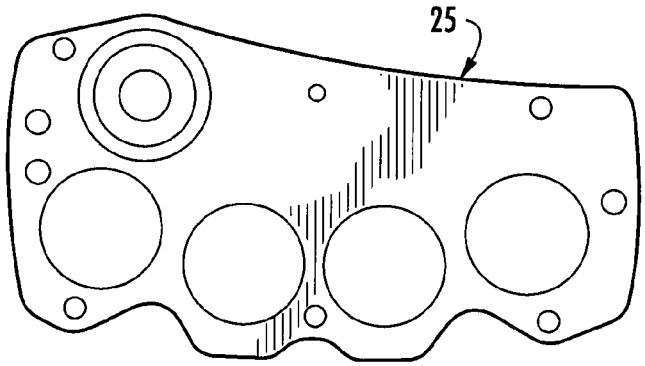
FIG. 3 is another side elevational view of the sheath.
Figure 8:
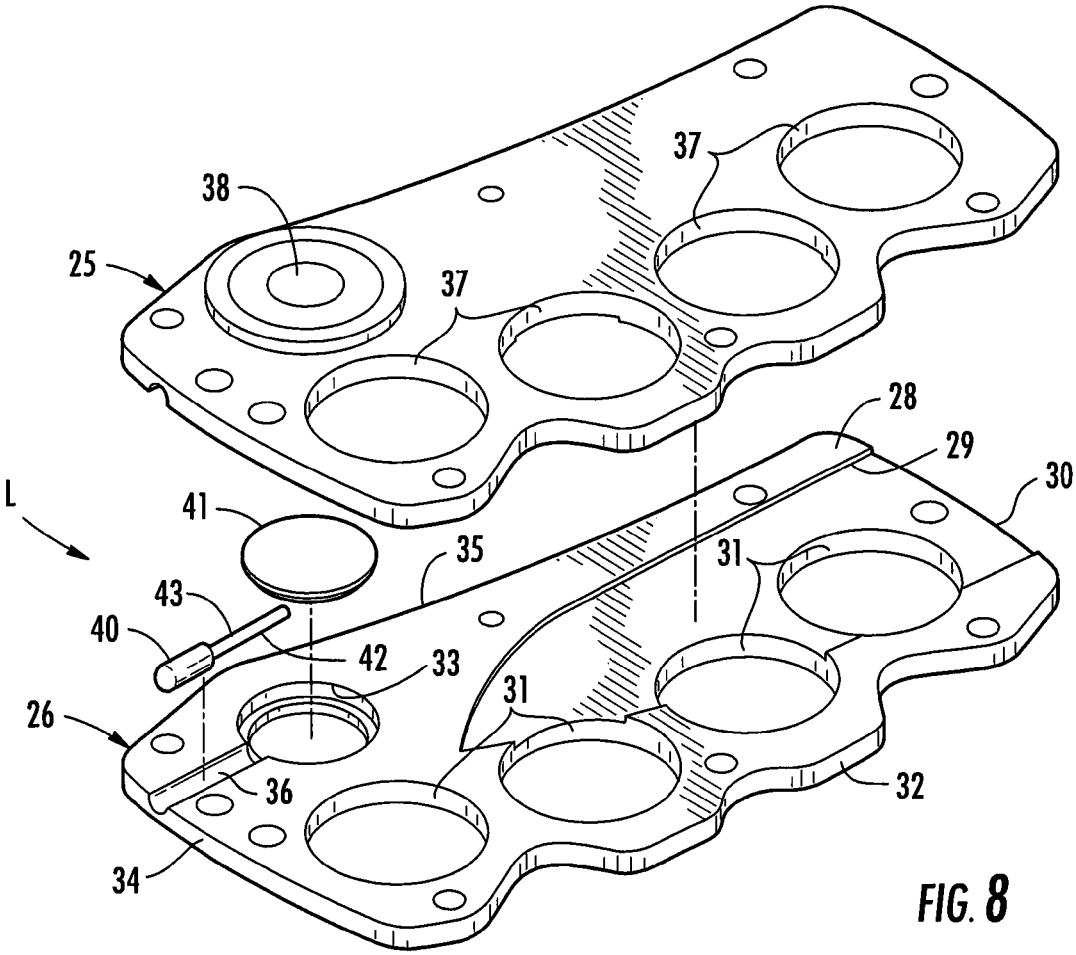
FIG. 8 is a perspective view of the sheath shown in FIG. 7, illustrating the components thereof in exploded relation.

Referring to FIGS. 1 and 2 of the drawings, there is illustrated a sheath 20 embodying the present invention which is adapted to hold a knife 21 having a handle portion 22 and a blade portion 23 projecting from handle portion 22 and insertable in the sheath. Sheath 20 generally consists of a housing 24 provided with a light emitting device L. As best shown in FIG. 8, sheath housing 24 consists of a pair of elongated panels 25 and 26 which are secured together in side-by-side relation by a set of rivets 27 extending through aligned openings about the peripheries of the panels. Inner surface 28 of housing panel 26 is provided by with a shallow recess 29 having a configuration corresponding to the configuration of blade portion 23, which communicates with the exterior of the housing through a rear edge 30 of panel 26, a set of longitudinally spaced, circular openings 31 disposed along an edge 32 and a circular recess 33 disposed adjacent end edge 34 and side edge 35. Panel surface 28 further is provided with a channel recess 36 disposed substantially radially relative to the circular recess 33 and communicating with the exterior of the housing through an edge 34. Housing panel 28 has an outside configuration similar to the outside configuration of housing panel 26, a recess on the inner surface thereof coinciding with recess 29 in housing panel 26 when the panel members are secured together, a set of spaced circular openings 37 which register with openings 31 when the housing panels are secured together and a depressible actuating button 38 which registers with recess 33 when the panels are secured together, and includes a flexing element biasing button 38 outwardly relative to housing panel 25.

Light emitting device L consists of a light emitting diode 40 energized by battery 41. Diode 40 is disposed in recess 36 and a registered recess in housing panel 25 and is provided with a set of leads 42 and 43 which project into recess 33. Battery 41 consists of a coin type lithium battery inserted in recess 33 between diode lead 42 which engages a terminal on one side of battery 41 and diode lead 43 which normally is spaced from the opposite side of the battery, in registry with actuating button 38. With diode 40 disposed in recess 36, battery 41 disposed in recess 33 and the housing panels secured together, depression of button 38 would cause lead 43 to engage a terminal on battery 41 to energize diode 40.

Figure 4:
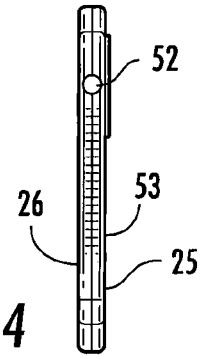
FIG. 4 is a front, elevational view of the sheath shown in FIG. 3.
Figure 5:
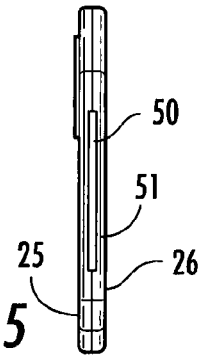
FIG. 5 is a rear, elevevational view of the sheath shown in FIG. 3.
Figure 6:
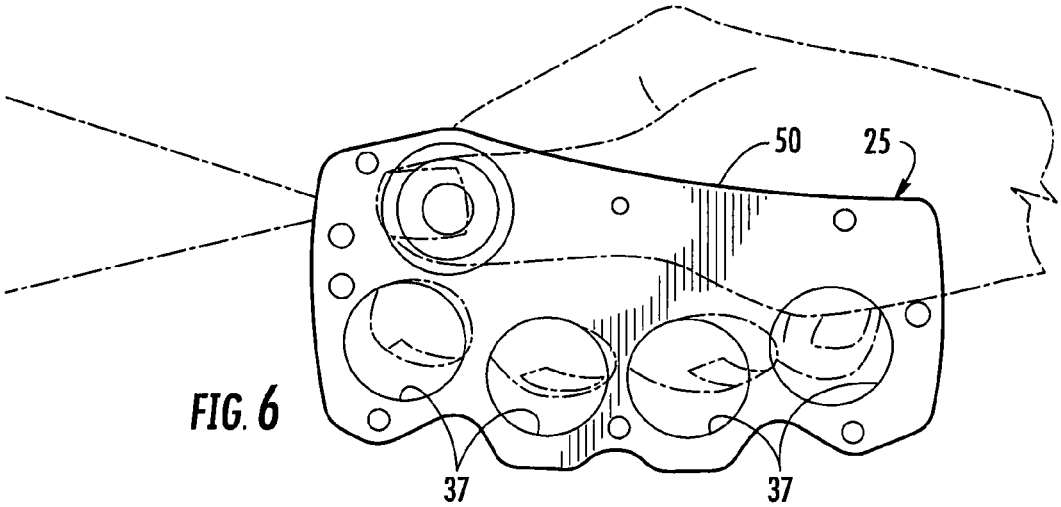
FIG. 6 is a view similar to the view shown in FIG. 3, further illustrating the matter in which the sheath is grasped by a user, in phantom lines.
Figure 7:
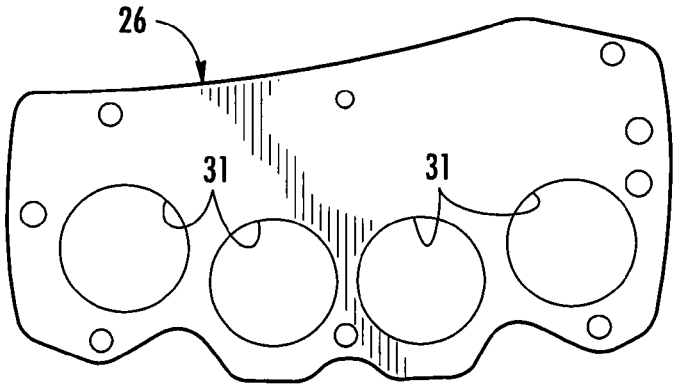
FIG. 7 is a view of the reverse side of the sheath shown in FIG. 3.

Referring to FIG. 6, when panels 25 and 26 are secured together as described, housing 24 will be seen to provide a particular configuration, openings 37 registered with openings 31 will be positioned relative to a side edge 50 of the housing and button 38 would be positioned relative to side edge 50 and openings 37 to permit the sheath to be grasped alongside 50, the fingers of the hand to be inserted through openings 37 to firmly grasp the sheath and the thumb of the hand to be positioned adjacent actuating button 38 to permit the button to be depressed to energize the light emitting diode. Preferably, the housing panels are formed of a nonelectrically conducting plastic material, and are produced by injection molding or any other suitable method. The sheath may be assembled by inserting diode 40 and battery 41 in the recesses provided in housing panel 26, inserting actuating button 38 and the flexing element in the recess provided on the inner surface of housing panel 25, positioning housing panel 25 in registry on housing panel 26 and securing such panels together with a set of rivets. With the housing panels thus secured together, the housing will be provided with a slot 50 in a rear edge 51 thereof as shown in FIG. 5, in which the blade portion 23 of knife 21 may be inserted as shown in FIG. 1. Such housing further would be provided with an outlet opening 52 in front edge 53 thereof as shown in FIG. 4 through which a light emitted by diode 40 is projected as shown FIG. 6.

Figure 9:
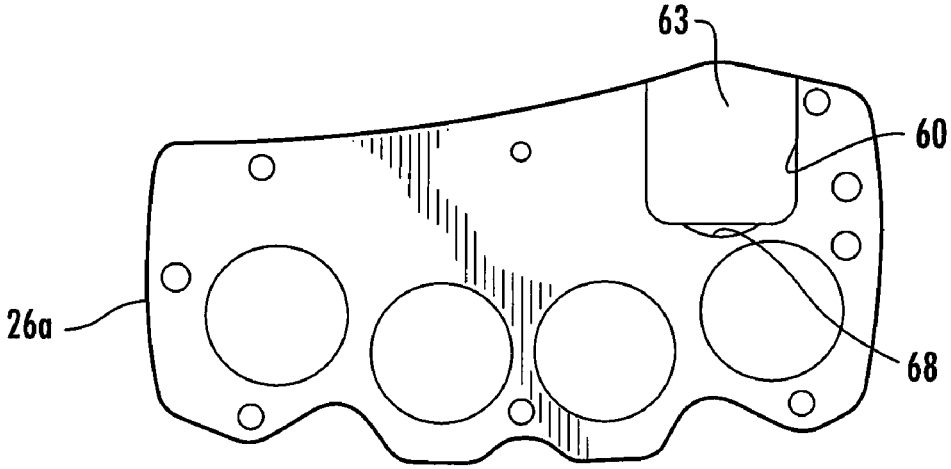
FIG. 9 is an elevational view of the reverse side of the lower component of the housing shown FIG. 8.
Figure 10:
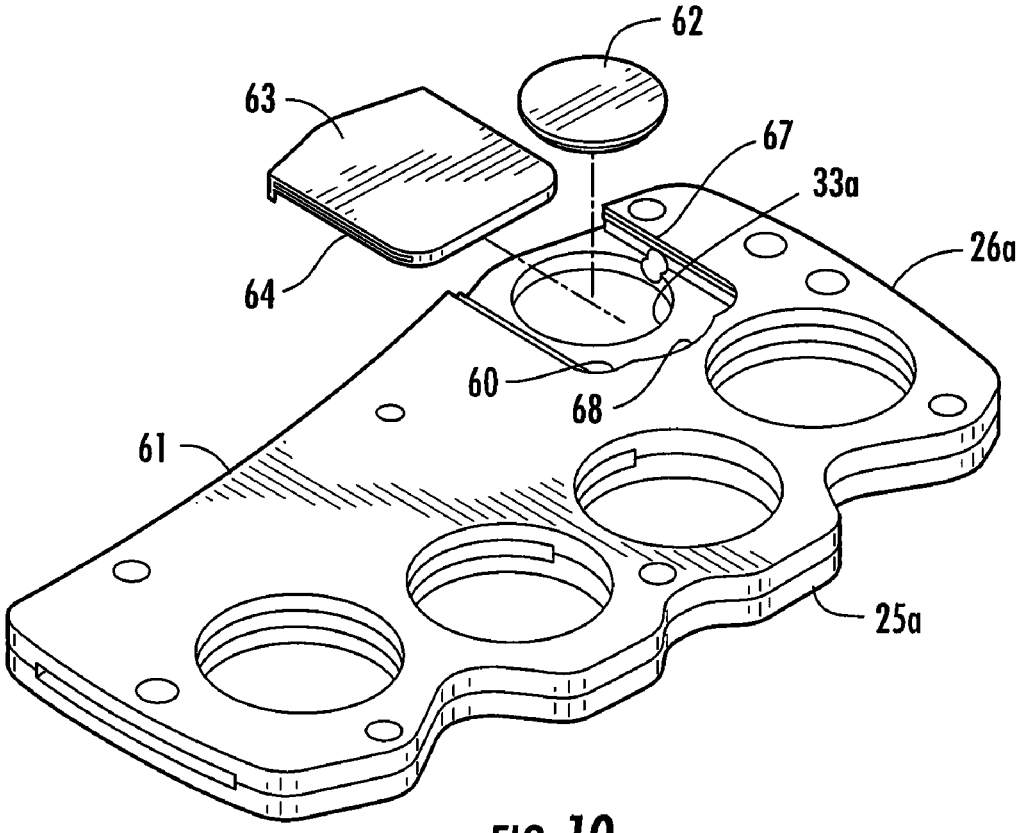
FIG. 10 is a perspective view of the embodiment shown in FIG. 8, illustrating the major components of the housing assembled together and the access means to the compartment for the replaceable battery shown in exploded relation.

FIGS. 9 and 10 illustrate another embodiment of the invention which is similar to the embodiment shown in FIGS. 1 through 8 but further provides for means for providing access to the battery thereof for replacement purposes. In such embodiment, housing panel 26*a* which is comparable to previously described housing panel 26 is provided with a shallow recess 60 in a side edge 61 thereof which registers with recess 33*a* in housing panel 25*a* comparable to previously described housing panel 25. Recess 33*a* is adapted to receive a coin type battery 62 and recess 60 is adapted to be closed in securing battery 62 in recess 33*a* by means of a cover panel 63. Closure of panel 63 is provided with tenons 64 and 65 (hidden) along side edges thereof which cooperate with a set of mortises 66 (hidden) and 67 on the sides of recess 60 to secure panel 63 in recess 60. The end of recess 60 may be recessed or at 68 so as to permit the insertion of the fingernail of a user to facilitate the sliding out of cover panel 63 in seeking to replace battery 62.

The sheath as described may simply be carried by a user. Preferably, however, the sheath with a knife inserted therein may be attached to the attire of the user simply by insertion of the sheath within a belt, waistband or pocket of the user or by means of a clip formed on the sheath housing and attachable to the attire of the user. Typically, the sheath would serve simply to carry the knife. However, when appropriate, the knife maybe withdrawn from the sheath, the sheath may be grasped as shown in FIG. 6 and the sheath may be utilized as an illuminating device simply by utilizing the thumb to press the actuating button on the sheath to energize the diode. In doing so, the extraction of the knife permits the fingers of the user to be inserted through the openings provided in the sheath housing to position the thumb of the user adjacent the actuating button of the diode device.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

The invention claimed is:

1. A knife and sheath for housing the knife, comprising:

a knife having a handle and a blade projecting from the handle; and a sheath configured to hold the knife, the sheath comprising:

a sheath housing having an interior, and exterior, a front edge, an opposite rear edge, a first side edge and an opposite second side edge, an inner recess within the sheath housing configured to receive the blade of the knife and a slot in communication with the exterior of the sheath housing, wherein the knife is held by the sheath by inserting the blade through the slot and into the recess, a light emitting device within the housing and positioned adjacent an opening of the housing so as to project light out of the opening, the light emitting device including a battery to power the light emitting device and an actuator adjacent the exterior of the housing for activation of the light emitting device, a plurality of completely enclosed finger receiving openings defined through the housing and longitudinally spaced adjacent one of the side edges of the housing for receiving fingers of a user, the inner recess within the sheath housing configured to receive the blade of the knife overlying at least one of the finger receiving openings and including a slot in communication with the exterior of the sheath housing, wherein the knife is held by the sheath by inserting the blade through the slot and into the recess, with the blade substantially blocking the at least one of the finger receiving openings overlayed by the recess, wherein the knife blade may be withdrawn from the sheath to permit the fingers of the user to be inserted through the finger receiving openings and enable a thumb of the user to be positioned on the actuator for selective activation and de-activation of the light emitting device.

2. The knife and sheath of claim 1, wherein the light emitting device is a light emitting diode.

* * * * *